United States Patent [19]

Leonard

[11] 4,253,404

[45] Mar. 3, 1981

[54] NATURAL DRAFT COMBUSTION ZONE OPTIMIZING METHOD AND APPARATUS

[75] Inventor: Donald J. Leonard, Lagunitas, Calif.

[73] Assignee: Chevron Research Company, San Francisco, Calif.

[21] Appl. No.: 126,258

[22] Filed: Mar. 3, 1980

Related U.S. Application Data

[63] Continuation-in-part of Ser. No. 972,110, Dec. 21, 1978.

[51] Int. Cl.[3] ..... F23N 5/18

[52] U.S. Cl. ..... 110/188; 122/448 S; 236/15 E; 431/13; 431/90

[58] Field of Search ..... 122/446, 448 R, 448 S, 122/449; 110/186, 188, 190, 189; 236/15 E, 15 C; 431/76, 90, 13, 14

[56] References Cited

U.S. PATENT DOCUMENTS

| | | | |
|---|---|---|---|
| 3,074,644 | 1/1963 | Geniesse | 236/15 E |
| 3,184,686 | 5/1965 | Stanton | 328/69 |
| 3,243,116 | 3/1966 | Dijt et al. | 236/15 E X |
| 3,723,047 | 3/1973 | De Livois | 431/76 |
| 4,097,218 | 6/1978 | Womack | 431/76 |
| 4,147,500 | 4/1979 | Karlsoen | 236/15 E X |

OTHER PUBLICATIONS

*Improving the Efficiency of Industrial Boilers by Microprocessor Content,* Takacs, Power 121, 11, 80–83, (1977).

*Primary Examiner*—Edward G. Favors

*Attorney, Agent, or Firm*—D. A. Newell; W. H. Hooper; R. H. Evans

[57] ABSTRACT

Control method and apparatus for optimizing the operation of a natural draft combustion zone through which a conduit containing a process fluid to be heated passes, by decreasing the supply of combustion air until one or more of the following predetermined limiting conditions is reached: maximum CO in the flue gas, minimum $O_2$ in flue gas, minimum draft in the combustion zone, maximum temperature of the outer surface of said conduit, and increase in the rate of fuel addition above a minimum amount. When a limiting condition is reached, the supply of combustion air is increased until the limiting condition is no longer present, and the cycle then repeated.

4 Claims, 3 Drawing Figures

NATURAL DRAFT COMBUSTION ZONE OPTIMIZING METHOD AND APPARATUS

CROSS-REFERENCE TO RELATED APPLICATION

This application is a continuation-in-part of application Ser. No. 972,110, filed on Dec. 21, 1978.

FIELD OF THE INVENTION

This invention relates to a method and apparatus for controlling the operation of a combustion zone in such a way that combustion is carried out at an optimum efficiency consistent with safe, low-pollution operation.

BACKGROUND OF THE INVENTION

In recent years the use of apparatus for controlling various processes such as chemical processes, petrochemical processes and processes for the distillation, extraction and refining of petroleum and the like have been developed. With the help of these apparatus, certain variables of the process may be measured and, in response, certain inputs controlled to enable the process to be operated in the most economical manner consistent with safe operation.

For example, in furnaces for heating process fluids, the temperature of the heated fluid leaving the furnace is measured and the amount of fuel is automatically regulated to maintain the heated fluid at the desired temperature. Under given furnace, fuel and atmospheric conditions, it takes a specific volume of combustion air to completely burn the fuel. An insufficient supply of combustion air (oxygen) leaves unburned fuel in the combustion zone—which is very inefficient and potentially dangerous. On the other hand, if there is an excess of combustion air, extra fuel is required to heat it, and the heated excess air is then usually passed uselessly out of the furnace stack—an inefficient mode of operation. Thus, there is a need for controlling the supply of combustion air to furnaces to minimize periods of operation under conditions of excess air or excess fuel.

On many furnaces, especially natural-draft furnaces, the air required for combustion is controlled manually, such as by a damper arrangement in the incoming air stream or in the furnace stack. Normally, too much air is supplied to the furnace because, although inefficient, this represents safe operation and requires minimal operator attention.

One type of existing controller maintains a preset air-to-fuel ratio by varying the flow of air responsive to changes in the flow of fuel. Another type maintains a predetermined level of oxygen in the flue gas by using an oxygen analyzer.

A more advanced system, described in U.S. Pat. No. 3,184,686, describes an apparatus which controls the operation of a furnace by slowly reducing excess air until an optimum is reached, and then oscillating the amount of air about the optimum. Thus, the combustion zone is operated part of the time under fuel-rich conditions and part of the time under oxygen-rich conditions.

Yet another control system, described in an article entitled "Improving the Efficiency of Industrial Boilers by Microprocessor Control" by Laszlo Takacs in Power 121, 11, 80–83 (1977), uses a microprocessor to optimize the air-fuel ratio of a boiler based on feedback signals from stack-gas oxygen and combustible-materials analyzers, with the use of a CO analyzer being discussed.

A need still exists, however, for an optimizing controller and method which will allow a combustion zone to be operated so that maximum efficiency can be achieved safely even under varying process and atmospheric conditions and fuel composition. Particularly with respect to fired furnaces, a need exists for a method and apparatus which will control the supply of combustion air at a minimum without creating fuel-rich conditions and minimize the production of pollutants such as $NO_x$ in the stack gas.

SUMMARY OF THE INVENTION

According to one aspect of the present invention, there is provided a method for optimizing the operation of a natural draft combustion zone having a fuel supply, a combustion air supply, and through which a conduit containing a process fluid to be heated passes, which comprises:

(a) increasing the flow rate of said combustion air as necessary to maintain the CO concentration in the flue gas below a predetermined maximum, as necessary to maintain the $O_2$ concentration in the flue gas above a predetermined minimum, as necessary to maintain the draft in the combustion zone above a predetermined minimum, as necessary to maintain the temperature of the outer surface of the conduit below a predetermined maximum and whenever the rate of increase in the rate at which fuel is supplied to the combustion zone exceeds a predetermined maximum; and (b) decreasing the flow rate of the combustion air whenever an increase in the combustion air flow rate is not necessary to accomplish step (a).

The controller will also signal an alarm whenever both high CO concentrations and high $O_2$ concentration exist simultaneously. Alarms will also be signaled in the event of high oxygen and low draft or low oxygen and high draft.

According to another aspect of the present invention, there is provided an apparatus for optimizing the operation of a combustion zone having a fuel supply, a combustion air supply and through which a conduit containing a process fluid to be heated passes, which comprises:

(a) means for determining whether any of the following conditions is present: a CO concentration in the flue gas at or above a predetermined maximum, an $O_2$ concentration in the flue gas at or below a predetermined minimum, a draft in the combustion zone at or below a predetermined minimum, a temperature of the outer surface of the conduit at or above a predetermined maximum, and a rate of increase in the rate at which fuel is supplied to the combustion zone at or above a predetermined maximum;

(b) means for increasing the flow rate of the combustion air whenever any of said conditions is present and for decreasing the flow rate of the combustion air whenever none of the conditions are present; and (c) means for signaling the operator in the event of certain conditions.

As used herein a natural draft combustion zone is a combustion zone in which inspiration of combustion air is controlled by maintaining a negative pressure in said combustion zone relative to ambient atmospheric pressure. Draft is the difference between the pressure inside the combustion zone and ambient atmospheric pressure, and is usually a negative number because of the relatively low pressure in the combustion zone. A high draft is indicated by a large negative pressure and a low draft is indicated by a low negative pressure or even a positive pressure.

The novel features are set forth with particularity in the appended claims. The invention will best be understood, and additional objects and advantages will be apparent, from the following description of a specific embodiment thereof, when read in connection with the accompanying Figures which illustrate the operation of and benefits to be obtained from the present invention.

DETAILED DESCRIPTION

The invention and the preferred control equipment and method will now be illustrated with reference to the Figures.

Figure 1:
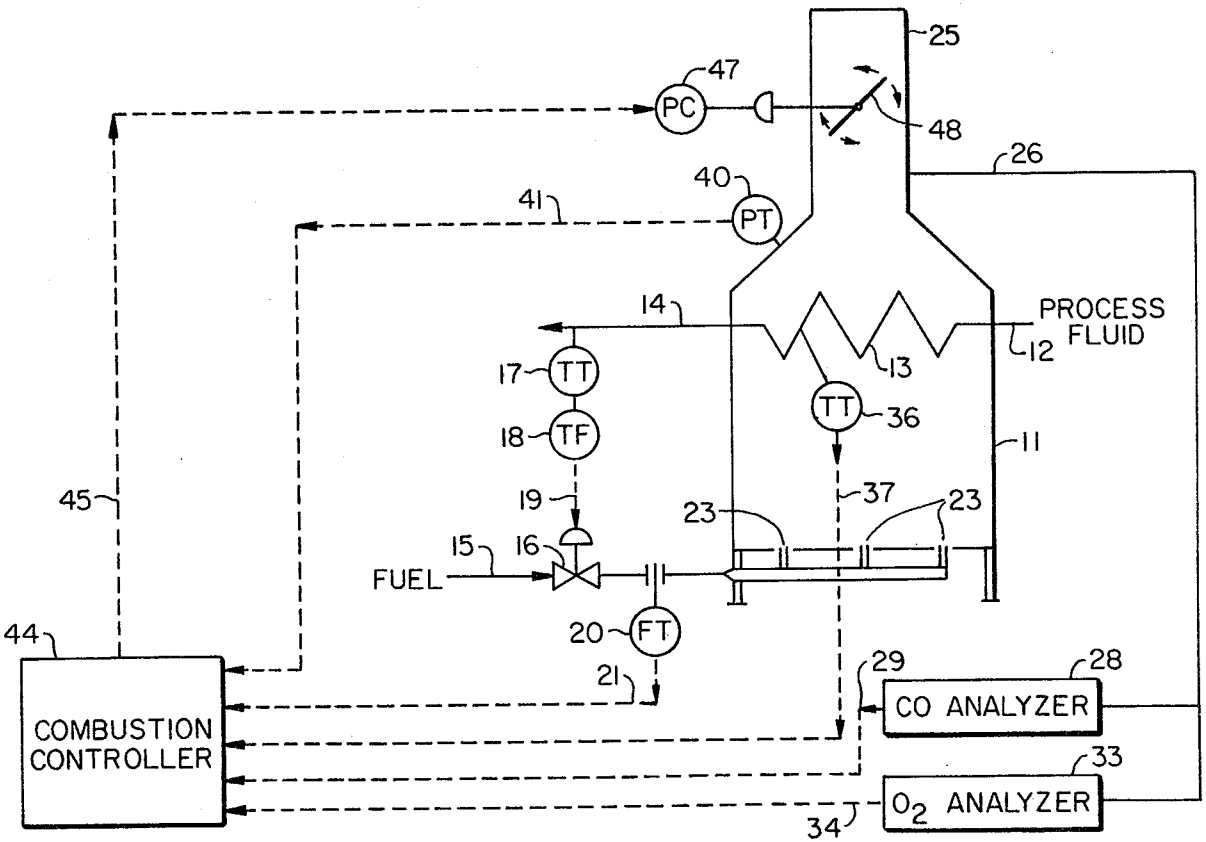
FIG. 1 is a block diagram showing a process controlled according to a preferred embodiment of the present invention.

Referring to FIG. 1, there is shown an exemplary natural-draft furnace 11, box-shaped with multiple burners (oil or gas), a stack damper and a duty of 88 MM Btu/hr (25,800 kilowatts). However, it will be appreciated that almost any type of natural draft fired furnace may be subject to the control method and apparatus of the present invention regardless of whether the fuel is in a gaseous, liquid or solid form, and regardless of the furnace size and shape, the number of burners or stacks, etc., even though it may be desirable to incorporate additional limiting conditions into the present control method.

A process fluid to be heated is introduced into furnace 11 via conduit 12, and crosses the interior of the furnace in a number of passes 13 before being removed via conduit 14. Fuel is supplied to representative burners 23 of furnace 11 via line 15 at a rate determined by the position of control valve 16 in line 15. The position of control valve 16 is varied responsive to signal 19 received from temperature controller 18. Controller 18 determines variation from a set point of a temperature signal received from transmitter 17 which is placed to sense the temperature of the heated process fluid as it exits furnace 11 via conduit 14. Thus, when the temperature of the process fluid falls below a certain level, an additional supply of fuel to the combustion zone is called for via line 19, causing valve 16 to open and allow additional fuel to pass into the combustion zone. Combustion air from the atmosphere enters combustion zone 11 through openings in burners 23.

The fuel flow rate in conduit 15 is detected by flowmeter 20. Any suitable flowmeter may be used, such as a velocity meter, a head meter or a displacement meter. Flowmeter 20 transmits via line 21 a signal which is related to the rate of fuel flow in conduit 15.

From stack 25 of furnace 11, a sample stream of flue gas is withdrawn via conduit 26. A portion of the flue gas sample stream is passed to CO analyzer 28. This analyzer may be any suitable automatic CO analyzer, for example Beckman Model 865 CO analyzer with autocalibration, sold by Beckman Instruments Inc., 2500 Harbor Blvd., Fullerton, Calif. The CO analyzer transmits via line 29 a signal related to the concentration of CO in the flue gas.

Another portion of the sample stream in conduit 26 is passed to $O_2$ analyzer 33. This analyzer may be any suitable automatic $O_2$ analyzer, for example, one manufactured by Teledyne Inc., 1901 Avenue of the Stars, Los Angeles, Calif. $O_2$ analyzer 33 transmits via line 34 a signal related to the concentration of $O_2$ in the flue gas.

Inside furnace 11, some passes of conduit 13 are closer to the burner flames than others are. Temperature sensors 36, usually thermocouples, are placed on the skin or outer surface of the conduit 13 where it is nearest the burners and where overheating or flame impingement is most likely to occur. These temperatures are detected and transmitted via line 37.

The remaining variable which is measured is the furnace draft which may be measured by a suitably located differential pressure sensor 40 which transmits a signal in line 41 responsive to the difference in pressure between the radiant heating section within the furnace and the ambient air outside the furnace.

Signals from lines 21, 29, 34, 37 and 41 are received by combustion controller 44. This controller may be any suitable controller capable of determining when a predetermined limit for a given signal has been reached or exceeded. One example of a suitable controller is a digital computer; however, it is preferred to use a microcomputer such as UDAC, manufactured by Reliance Electric Company, 24701 Euclid Avenue, Cleveland, Ohio. Controller 44 receives the various signals, compares them with their corresponding preset limits, and determines whether any limit has been reached. Controller 44 produces a signal which is used to control the flow rate of inlet air to the furnace by means such as a variable position damper, which may be located either in the exhaust stack or in an inlet air plenum, if one is present. In regard to FIG. 1, the signal from controller 44 is an analog signal which is transmitted via line 45 to actuator 47 operating damper 48 located in stack 25 of the furnace. If one or more of the limits has been reached, damper 48 will be opened and, as a result, more air will enter the combustion zone of furnace 11. If none of the limits has been reached, the damper will be slowly closed and, as a result, less air will enter the combustion zone.

The sequence in which controller 44 scans the operating signals to determine whether any of the limiting conditions is present may vary. One mode of operation is for the controller to continually or periodically examine each of the operating signals in series, and when one of the operating signals reaches its limiting condition, increase the flow of combustion air until the condition goes away, then slowly decrease the combustion air flow while searching for the same or another limiting condition. Another mode of operation is for the controller to decrease the flow of combustion air until one of the operating signals reaches its limiting conditions, continuously monitor that operating signal to maintain it at its predetermined limit, while continually or periodically examining the other operating signals. If conditions change so that another operating signal reaches its corresponding predetermined limit, the controller will increase the flow rate of combustion air until none of the signals are at their limit, then decrease the air flow to repeat the cycle.

An advantage of monitoring both the CO and $O_2$ levels is that each can serve as a check on the reliability of the other. For example, if the $O_2$ and CO levels are both very low, one of the analyzers is probably malfunctioning. Furthermore, the controller will preferably signal an alarm whenever both high CO concentrations and high $O_2$ concentrations are encountered. such a condition might arise if one or more of the burners, but not all, was being insufficiently supplied with oxygen. Ths situation would arise if a burner's register was obstructed or accidentally closed. By signaling an alarm, the operator in charge of the unit could inspect the system for malfunctions. For this purpose it is also necessary to select a predetermined maximum $O_2$ concentration level, such as 2.5%.

The fuel supply rate is monitored so that combustion air supply to the combustion zone can be rapidly increased prior to a transient increase in the fuel supply rate beyond a certain minimum, thus avoiding fuel-rich combustion zone conditions.

Preferably the controller will also signal an alarm in the case of the high predetermined oxygen level coupled with a low draft, and low oxygen levels coupled with a high draft. These particular changes might be encountered due to changes in the process heating load, thus requiring manual adjustment of the burner registers to permit the automatic damper control to function efficiently. For these purposes a high draft level would normally be set at $-0.457$ cm $H_2O$.

The limits for the variables which were established with regard to optimizing the operations of furnace 11 are presented below in Table I. Of course, the variables and their limits will vary from furnace to furnace and from process to process, and may be determined by a person of ordinary skill in the art.

TABLE I

| Variable | Limit | Rate Damper Opens |
|---|---|---|
| CO in flue gas | $\geqq$150 ppm | Normal |
| CO in flue gas | $\geqq$500 ppm | Twice normal |
| $O_2$ in flue gas | $\leqq$1.25% | Normal |
| Draft | $\leqq -0.127$ cm $H_2O$ | Normal |
| Skin Temp. | $\geqq$510° C. | Normal |
| Fuel increase | | |
| (over 30 sec.) | $\geqq$2.5% | Normal |
| (over 6 sec.) | $\geqq$5% | Variable |

The normal rate of damper opening is 100% of the total damper path per hour. On a large fuel increase in any 6-second time span, the controller will open the damper 1% for each % of fuel increase. When no limit has been reached, the controller closes the damper at a normal closing rate of 30% per hour. Multiple predetermined limits for an operating variable provide additional flexibility for the controller, with a corresponding increase in safety.

In operation, assuming the controller is activated when the combustion zone is supplied with excess air, the controller will signal for the damper to close at the rate of 30% per hour, and will periodically scan the operating variables, for example, one each second. The operating variables are compared with the corresponding preset limits, and the controller will continue closing the damper until one of the limits is reached. Although in this instance the control of combustion air is achieved with a damper positioned in the furnace stack, a damper in the inlet air plenum is also feasible.

As the flow of combustion air is reduced by closing the damper, any of the following conditions may be reached:

(1) a low draft, e.g., a combustion zone pressure greater than ambient outside pressure—this could lead to damage of structural components of the furnace, such as tile support hangers, and to flame instability and possibly explosive conditions, particularly if the combustion zone is fuel-rich;

(2) unburned fuel in the combustion zone—this condition is caused by fuel-rich or air-deficient operation and is inefficient and potentially explosive and in addition can cause emission of smoke from the furnace;

(3) a low $O_2$ level in the flue gas—this condition signifies incipient fuel-rich combustion zone operation;

(4) a high CO level—CO production rises rapidly as the fuel/air ratio approaches stoichiometric;

(5) a high temperature on the outer surface of one or more of the process fluid conduits—the temperature must be kept below the limit of safe operation. The decreasing supply of combustion air will cause the flames from the burners to lengthen and possibly impinge upon or terminate closer to one or more of the process fluid conduits than would be the case if more air were supplied to the combustion zone. For instance, if high surface temperature of a conduit is the first limit reached, the controller will then open the damper while continuing to check the other operating variables. Opening the damper allows more combustion air to enter the furnace, which will cause the length of the flames to decrease and thus the conduit surface temperature to decrease. When the conduit skin temperature is no longer at the limit, the controller again closes the damper until a limit is once again reached, and the cycle is repeated.

The control method and apparatus of the present invention is sufficiently flexible to control the operation of the furnace at minimal excess combustion air under changing operating conditions. For example, control was successfully maintained under changing atmospheric conditions, heat duties and fuel compositions when the furnace was switched from the burners being 100% gas fired to half the burners being gas-fired and half oil-fired.

Figure 2:
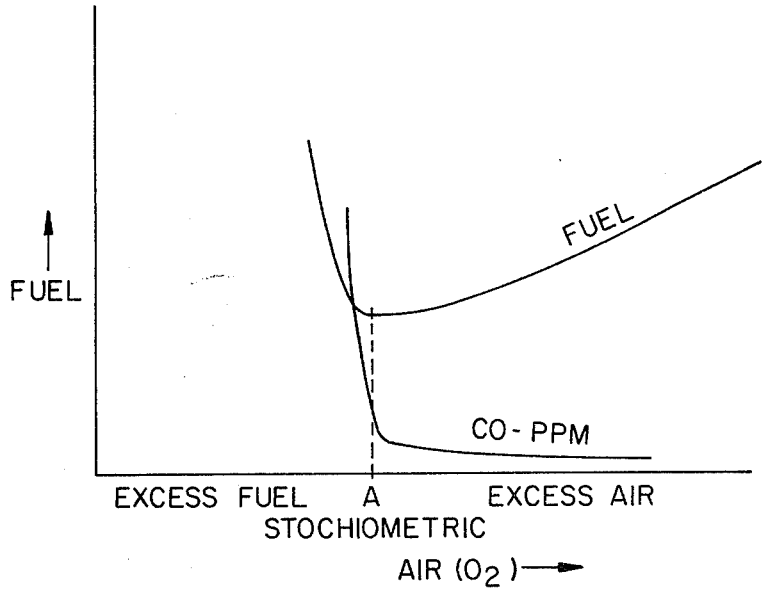
FIG. 2 is a graph showing the relationship between the supply of air ($O_2$), the demand for fuel and CO formation.

FIG. 2 illustrates the relationship between the supply of air and fuel and the formation of CO. A sharp increase in CO production is an indication that the combustion zone is being operated at very close to stoichiometric conditions. Point A represents the stoichiometric ratio of air to fuel—the most effective safe operating point for the combustion zone. The area to the left of point A represents operation under fuel-rich or oxygen-deficient conditions, while the area to the right of point A represents operation under air-rich or fuel deficient conditions. Operation to the left of point A is unsafe because the unburned, excess fuel is potentially explosive. Operation very far to the right of point A is undesirable because fuel is wasted heating the excess air. Operation at point A and immediately to its right is thus the most desirable operating span. The control method and apparatus of the present invention regulates the combustion air supply to maintain combustion conditions from slightly oxygen-rich to stoichiometric, but does not allow excursion into oxygen-deficient (potentially unsafe) operation.

Figure 3:
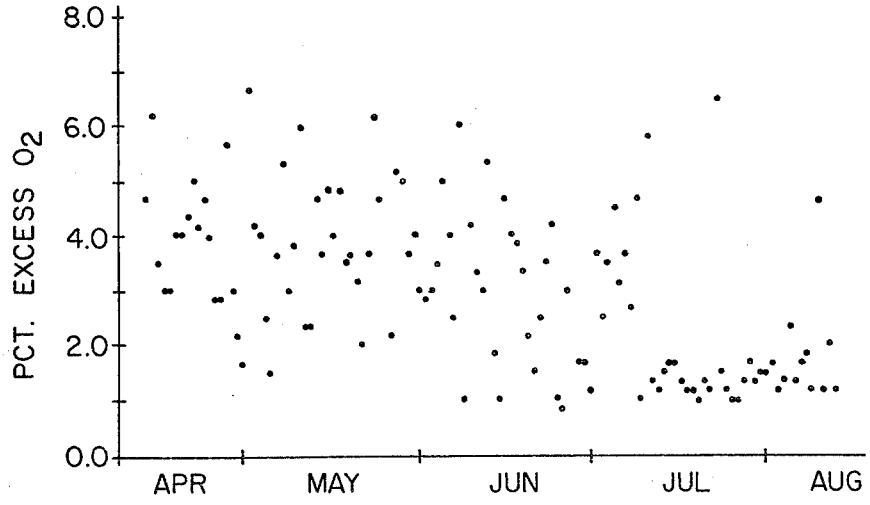
FIG. 3 is a chart showing results from the use of the method and apparatus of the present invention.

The effectiveness of the present invention can be shown by a comparison of the data that were taken on the oxygen content of the flue gas for the furnace described in connection with the preferred embodiment. In the initial period, the furnace was operator-controlled with the assistance of visual readouts from a flue gas $O_2$ analyzer, a draft indicator, a fuel flow recorder and process fluid conduit skin temperature sensors. As shown in FIG. 3, the $O_2$ content of the flue gas, from the period of April to early June when the furnace was under operator control, varied widely from 2 to 6%, averaging about 4%. For the rest of June and the first week of July, the combustion air supply to the furnace was controlled part of the time by the method and apparatus described in the present invention, and in the rest of July and in August the combustion air supply was completely controlled by the method and apparatus of the present invention. In the later period, the excess oxygen content of the flue gas varied from 1 to 2%, averaging about 1.5%. Thus, by implementing the method and apparatus of the present invention, a 2.5% decrease in the amount of oxygen supplied to the furnace was effected, representing a 1.7% increase in furnace combustion efficiency and a $31,000 annual fuel savings. In addition, $NO_x$ emissions in the flue gas were significantly reduced, presumably because the reduced amount of excess air reduced the amount of oxygen available to react with the nitrogen. Thus, with the present invention, not only is efficiency increased, but also the amount of pollutants given off is decreased.

From the foregoing description of the preferred embodiment, it is seen that the present invention provides a simplified method and apparatus for controlling the operation of a natural draft combustion zone by decreasing the supply of combustion air in order to drive combustion conditions toward an optimum within the limits of safe operation, and hold it at said optimum without exceeding any of the limits. The important consideration is that operation against a limiting condition represents the absolute maximum efficiency safely attainable under existing process conditions, despite the fact that those conditions are always changing.

It will be recognized that the method and apparatus of the present invention may be adapted to accommodate furnaces having wide, fast load fluctuations, a leaky combustion zone or sample system, inlet air control plus stack dampers, more than one heater using a common stack, more than one stack for one heater, and similar alternatives.

Other embodiments of the invention will be apparent to those skilled in the art from a consideration of this specification or practice of the invention described therein. It is intended that the specification be considered as exemplary only, with the true scope and spirit of the invention being indicated by following claims.

What is claimed is:

1. Method for optimizing the operation of a multiple burner natural draft combustion zone having a fuel supply, a combustion air supply and through which a conduit containing a process fluid to be heated passes, which comprises:

(a) increasing the flow rate of said combustion air as necessary to maintain the CO concentration in the flue gas below a predetermined maximum, as necessary to maintain the $O_2$ concentration in the flue gas above a predetermined minimum, as necessary to maintain the draft in the combustion zone above a predetermined minimum, as necessary to maintain the temperature of the outer surface of said conduit below a predetermined maximum and whenever the rate of increase in the rate at which fuel is supplied to the combustion zone exceeds a predetermined maximum;

(b) decreasing the flow rate of said combustion air whenever an increase in said combustion air flow rate is not necessary to accomplish step (a); and (c) signaling an alarm whenever the CO concentration is above its predetermined maximum and the $O_2$ concentration is above a predetermined maximum.

2. A method as recited in claim 1, further comprising:

signaling an alarm whenever the $O_2$ concentration is above its predetermined maximum and the draft is below its predetermined minimum; and signaling an alarm whenever the $O_2$ concentration is below its predetermined minimum and the draft is above its predetermined maximum.

3. Apparatus for optimizing the operation of a multiple burner combustion zone having a fuel supply, a combustion air supply and through which a conduit containing a process fluid to be heated passes, which comprises:

(a) means for determining whether any of the following conditions is present: a CO concentration in the flue gas at or above a predetermined maximum, an $O_2$ concentration in the flue gas at or below a predetermined minimum, a draft in the combustion zone at or below a predetermined minimum, a temperature of the outer surface of said conduit at or above a predetermined maximum, and a rate of increase in the rate at which fuel is supplied to the combustion zone at or above a predetermined maximum;

(b) means for increasing the flow rate of said combustion air whenever any of said conditions is present and for decreasing the flow rate of said combustion air whenever none of said conditions are present; and (c) means for signaling an alarm whenever the CO concentration is above its predetermined maximum and the $O_2$ concentration is above a predetermined maximum.

4. Apparatus as recited in claim 3, further comprising:

means for signaling an alarm whenever the $O_2$ concentration is above its predetermined maximum and the draft is below its predetermined minimum; and means for signaling an alarm whenever the $O_2$ concentration is below its predetermined minimum and the draft is above its predetermined maximum.

* * * * *